United States Patent [19]

Uhlir

[11] 4,014,189

[45] Mar. 29, 1977

[54] HOSE KNITWORK HAVING A CLOSED TOE PORTION

[75] Inventor: Pavel Uhlir, Trebic, Czechoslovakia

[73] Assignee: Elitex, Zavody textilniho strojirenstvi, generalni reditalstvi, Liberec, Czechoslovakia

[22] Filed: June 25, 1974

[21] Appl. No.: 482,851

[30] Foreign Application Priority Data

June 29, 1973 Czechoslovakia ..... 4723/73

[52] U.S. Cl. ..... 66/187

[51] Int. Cl.[2] ..... D04B 9/54; D04B 9/56

[58] Field of Search ..... 66/187, 172 E, 185, 66/186, 178 A

[56] References Cited

UNITED STATES PATENTS

| | | | |
|---|---|---|---|
| 2,799,151 | 7/1957 | Elder et al. | 66/172 E |
| 3,166,922 | 1/1965 | York et al. | 66/172 E |
| 3,290,904 | 12/1966 | Snyder | 66/178 A X |
| 3,453,843 | 7/1969 | Knohl et al. | 66/185 |
| 3,550,402 | 12/1970 | Colton | 66/187 X |
| 3,728,875 | 4/1973 | Hartigan et al. | 66/172 E |
| 3,757,539 | 9/1973 | Millar | 66/187 X |
| 3,884,052 | 5/1975 | Findlay et al. | 66/187 |
| 3,906,753 | 9/1975 | Siegfried | 66/172 E |

FOREIGN PATENTS OR APPLICATIONS

| | | | |
|---|---|---|---|
| 1,718,269 | 3/1956 | Germany | 66/172 E |
| 1,909,645 | 11/1969 | Germany | 66/187 |

*Primary Examiner*—Mervin Stein
*Assistant Examiner*—A. M. Falik

[57] ABSTRACT

A hose knitwork such as stockings, socks and the like having a closed toe portion. The closed toe portion is made in the form of a pocket closed substantially at its central section by a wrapping yarn. The toe portion is knit on a circular knitting machine with a combination of loop wales of which certain of the wales have a higher number of loops while the other wales have a lesser number of loops in the same course length. The wales having a lower number of loops may be regularly alternated with those wales having a higher number of loops. The wales having a higher number of loops may be provided with regularly alternating loops of elastic and non-elastic yarns while the wales having fewer loops may be formed with non-elastic yarns. The combination of loop wales may be provided by providing certain of the wales with loops formed of elastic yarn while the other wales are formed with loops formed of non-elastic yarns.

5 Claims, 7 Drawing Figures

Fig-5
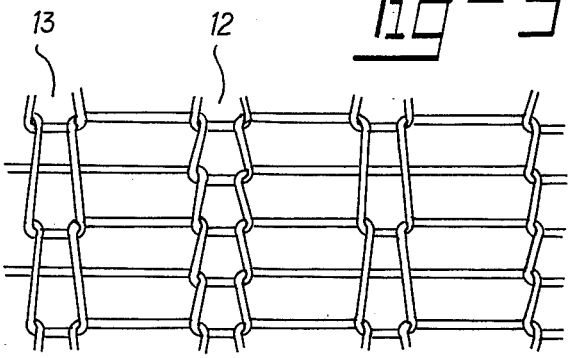
Fig-6
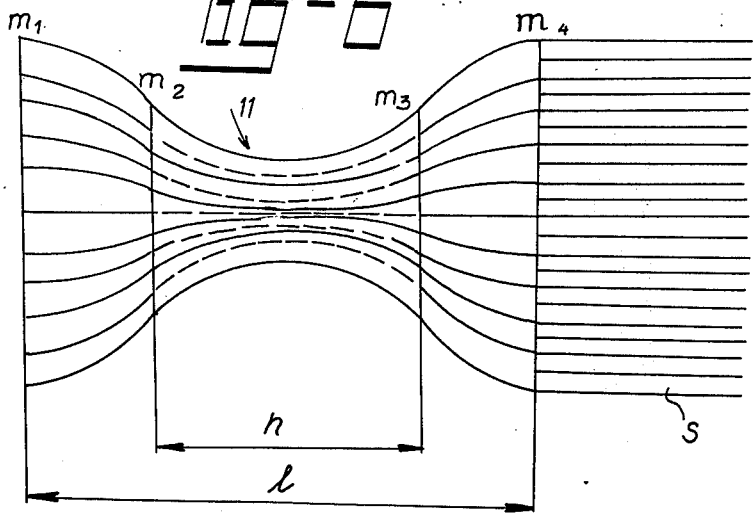
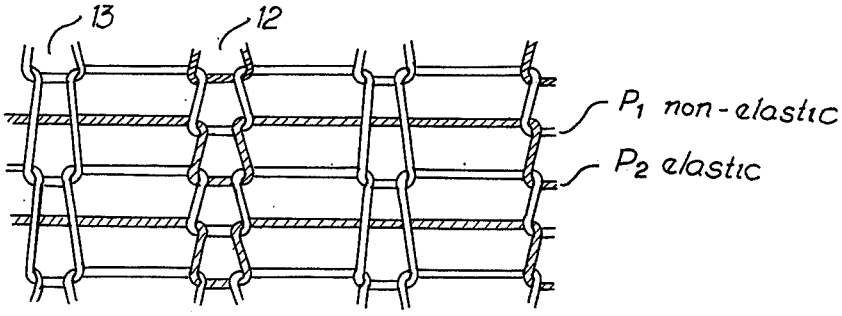
Fig-7

HOSE KNITWORK HAVING A CLOSED TOE PORTION

BACKGROUND OF THE INVENTION

The present invention relates to the knitting of seamless hose and in particular to the method of forming hosiery such as socks, stockings and the like with closed toe portions in the form of a pocket which is constricted about its center.

Methods of closing the toe portions of knitted hosiery are well known in which the hose is twisted and/or constricted directly on the knitting machine to form a closed pocket. Such techniques present a particular problem which has as yet not been solved with sufficient satisfaction. The twisting or constricting of the hose confines the knitwork forming the wall of the hose into a diameter several times smaller than the diameter of the knitwork actually formed on the knitting machine. Consequently an undesirable and uncontrolled layering and overlapping of the knitwork takes place in the constricted section and as a result a lower quality of hose is produced both from the viewpoint of appearance as well as from wearability. Additionally the overlapping layers of fabric are uncomfortable and become a cause of sore feet during wearing as a result of the pressing of the shoe against the toes.

One of the methods of solving this problem, reduces the volume of the knitwork by omitting some loop courses in the section of the toe portion to be constricted. When knitting the toe portion of the hose as the final step, this is performed by not knitting the toe portion on all of the needles in the cylinder and the needles are brought to such a position that they do not catch the yarn. As a result free sections are formed between two adjacent loop wales. This method successfully reduces the volume of the knitwork but it does not overcome the unsightly overlaping and layering of the knitwork in the closed area, because it does not successfully reduce the overall diameter of the toe portion.

Another solution which has been attempted called for knitting the knitwork of the closing toe portion from a rib structure having the inherent property of causing the hose to assume a smaller diameter. This can be obtained by forming the purl loop wales so that they are displaced in the knitwork behind the rib loop wales. As a result the outer circumference of the hose has a smaller number of loop wales than the actual number of wales in the knitwork. This solution, however, has the disadvantage in that it can be only formed on a knitting machine having two needle beds and thus in particular is adaptable only to two cylinder circular machines.

It is the object of the present invention to provide a method for forming hose having closed toe portions which overcome the disadvantages and defects of the prior art method.

It is another object of the present invention to provide circular knit hose having an improved closed toe portion in which the disadvantages and defects of overlapping and layering common in the prior art are avoided.

It is another object of the present invention to provide a circular knit hose having reduced volume and yarn in the constricted portion and which may thus be closed in a more efficient and improved manner.

It is still another object of the present invention to provide a method for forming circular knit hose having an improved closed toe portion capable of being knit on one needle cylinder machine as well as on two needle cylinder machines.

The foregoing objects, other objects and the numerous advantages of the present invention method and hose will be apparent from the following disclosure of the preferred embodiments of the present invention.

SUMMARY OF THE INVENTION

According to the present invention a circular knit hose is provided with a closed toe portion formed of a pocket in which at least that section which is to be closed and constricted has a combination of loop wales in which some of the wales have a higher number of loops and the other wales have a smaller number of loops for the same knitwork length.

Preferably, the wales having a higher number of loops are regularly alternated with those wales having a smaller number of loops. In a further aspect of the present invention the combination of loop wales may be formed from the combined use of elastic yarns within elastic yarns. Preferably, the wales having fewer number of loops are formed with elastic yarns while the wales having a greater number of loops are formed with regularly alternating loops having elastic and inelastic yarns.

In another form of the present invention a circular knit hose is provided with a closed toe portion formed in a pocket in which at least the section to be constricted has a combination of loop wales in which some of the wales are formed of elastic yarn and the other wales are formed of inelastic yarn so as to provide a knitwork wall in which the wales are heterogeneous and in which the elastically formed wales may be radially offset behind the loop wales of non-elastic material.

In accordance with the present invention the toe portion is formed with a section having reduced volume as well as diameter thus permitting the constriction of the toe portion without overlapping layers.

The method according to the present invention for forming the circular knit hose described above employs a circular knitting machine having at least a two yarn feed system. At least the central section of the toe portion, which is to be constricted, is formed in a two yarn system by knitting one yarn on every second needle and by knitting both yarns on every needle of the total number of needles used to form the toe portion. Alternately the two yarn system may be used to feed an elastic yarn in one feed and a non-elastic yarn in the second feed. In the latter event the wales having a greater number of loops may be fed by both the elastic and non-elastic yarns or each alternating wale may be formed by elastic and non-elastic and non-elastic yarns respectively.

Full details of the present invention are set forth in the following description and are shown in the accompanying drawings.

BRIEF DESCRIPTION OF THE DRAWINGS

In the drawings:

FIG. 5 is an enlarged fragmentary diagramatic view of the stitch structure of the toe portion of the hose formed according to the present invention, FIG. 6 is a diagramatic development of the toe portion of the hose showing the distribution of the separate loop wales along the length of the toe portion, FIG. 7 is a view similar to that of FIG. 5 showing the stitch structure of the toe portion of the circular knit hose having elastic and non-elastic yarns in alternating wales.

DESCRIPTION OF THE INVENTION

The hose of the present invention may be formed on either a two or one cylinder circular knitting machine of conventional constructions. Such machines are well publicized and in such wide commercial use that those skilled in the present art are thoroughly familiar with them and the following description requires little detailing of their structure.

Figure 1:
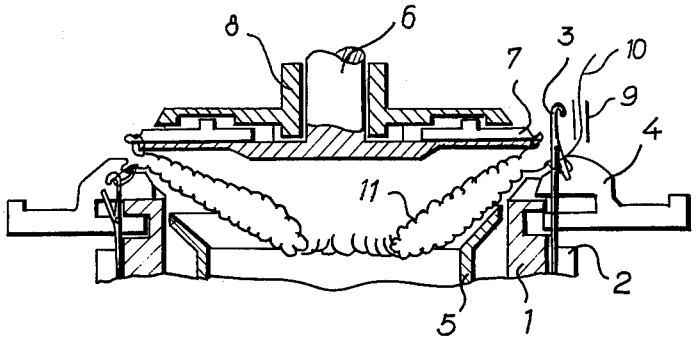
FIG. 1 is a sectional view of a fragment of a single cylinder knitting machine showing the formation of the toe portion of a circular knit hose.

The present invention is however specifically illustrated herein with respect to a single cylinder knitting machine. However, it will be understood that the same is not limited thereto. The machine as seen in FIG. 1 is provided with a rotary needle cylinder 1 having a plurality of longitudinal grooves or needle slots 2 arranged about its outer periphery. Each groove 2 is provided with a slidable needle 3 having a hooked and latched end which is adapted to cooperate with a horizontally slidable sinker 4 mounted in the usual sinker cam ring, not shown. A smooth bore withdrawal tube 5 is mounted within the needle cylinder through which the completed fabric may be taken up by conventional pneumatic or suction means. Coaxially arranged above the needle cylinder is a rotary dial 6 having a plurality of horizontally radially extending grooves in which are slidably arranged jacks 7 adapted to move inwardly and outwardly in cooperation with the needles 3 and the sinkers 4. The dial 6 is covered by a stationary lid 8 in which is formed the cams for actuation of the jacks 7. The needle cylinder 1 and dial 6 are rotated by suitable motor and transmission means including clutch means to provide selective conjoints and/or relative movement, in the well known manner.

Mounted adjacent the exterior of the cylinder 1 and dial 6 and in proximity to the axial space between them, there is located a plurality of yarn guides 9 through which a yarn 10 may be fed to the needles 3 while the cylinder is rotated. Thus is produced a circular fabric of a plurality of horizontal courses and vertical wales having a stitch or loop configuration predetermined by the relative location of the needles and sinkers, without the longitudinal seam and in full fashion construction.

As illustrated, the hose of the present invention may be formed by instituting knitting of the toe portion first. The empty needles 3 of the cylinder are first distributed such that each second needle 3 is held out of position and does not participate in the knitting process of the toe portion. In this manner the toe portion is to be knitted only on half of the number of needles of the needle cylinder. The toe portion of the hose is knit with two yarn feed systems. The first course of the knitwork ($m_1$ as seen in FIG. 6) is provided with the yarn through both the first and second feed systems and the needles and sinkers cooperate to knit at least a marginal and a first few courses so as to produce non-raveling welt. The sinker loops of the last welt course are engaged by the jacks 7. The jacks 7 hold the initial courses of the knitwork during the subsequent knitting of the toe portion generally indicated by the numeral 11. The kniting of the toe portion 11 is carried on from both the first and second yarn feeds on all of the needles 3 used to form the welt. That is on half of the needles 3 in the needle cylinder. The knitting is continued from the initial curse $m_1$ to a course $m_2$ which is approximately one third of the entire length 1 of the toe pocket portion 11.

After completion of approximately one third of the length 1 the distribution of the needles 3 in one of the feed systems is changed so that each second needle in that particular feed system is placed out of action. As a result the yarn associated with that particular feed system is fed only to every second needle associated with it and loops are formed only on such second needles. In the other feed system however the associated yarn is continued to be fed to all of the needles 3 used in the formation of the toe portion. In this manner certain wales, indicated by the numeral 12, are formed having a higher number of loops while other wales, indicated by the numeral 13, are formed having fewer numbers of loops in any given length or number of courses. The toe portion 11 is thus knit from the course $m_2$ through a course $m_3$, equal to a length of approximately two thirds of the toe portion to be closed with regularly alternating wales 12 having more short loops with yarns from both systems and wales 13 having fewer but longer loops of yarns from only one system. The yarns from both systems forming the wales 12 regularly alternate with each other in the formation of loops, as seen in FIG. 5.

The remaining one third of the toe portion 11, from course $m_3$ to $m_4$, is thereafter knit in the same manner as the initial toe portion from course $m_1$ to $m_2$, by feed yarns from both systems to all of the needles 3, being used to form the toe portion. In this manner a symmetrical toe portion 11 is formed having an overall length 1 from course $m_1$ through course $m_4$, sufficient to be folded on itself to form a pocket. The toe portion 11 has a central portion of a length h in which the volume and diameter of the knitwork is substantially reduced. The alternate wales 13 of fewer and longer loops tend to constrict the knitwork, providing less material for closing and thus enhances the actual closing of the toe. The alternate wales are each different from each other and provide a heterogeneous wale structure.

Figure 2:
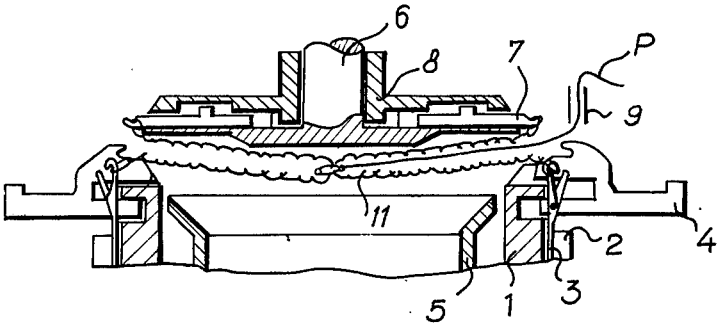
FIGS. 2 through 4 are views similar to that of FIG. 1 showing sequentially the steps of closing the toe portion.

As soon as the entire length 1 of the pocket 11 is knit then all the needles used in the formation of the toe portion 11 are brought to a rest position at the level of the sinkers 4, as seen in FIG. 2. At this position the needles do not take up at least one of the yarns P which lays between the needles and the jacks. Simultaneously the drive of the jack dial 6 is interrupted as by selectively disconnecting the drive clutch connecting the same to the drive means, so that the positive rotation of the drive is discontinued causing the yarn P to lay about the center of the toe portion 1. Due to inertia, the dial 6 is thus retarded in its rotation relative to the needle cylinder 1 and the course of the pocket 11 held on the jacks 7 begins to overrun against the course held on the needle 3. This forms a slight twist in the central section of the knitted toe portion engaging the closing yarn P thereabout. Thereafter the dial and needle cylinder are rotated by at least 180° wrapping the yarn P tightly about the central section closing the yarn pocket about its center. The yarn P is held under controlled tension, as by braking the yarn P as it is being fed through its guide, so that it tightly winds about the central section of the pocket 11 securely holding the yarn to itself. The yarn P thus winds itself into as small a point as possible in which the yarns hold each other and avoid unraveling. The central section of the toe portion 11 is consequently securely closed and wrapped by several layers of yarn without the need for knotting or interlooping of the yarn P with the loops of the knitted feed systems.

Upon closing of the pocket 11, the loops of the wales 12, having a higher number of loops, tend to be displaced and become offset radially inwardly behind the wales 11 having fewer loops. Thus, due to the hererogeneity of the knitwork the outer circumference of the pocket 11 is formed with fewer loops than actually comprise the wall of the knitwork. This reduces the tendency of the knitwork to overlap when constricted by the closing yarn P.

Figure 3:
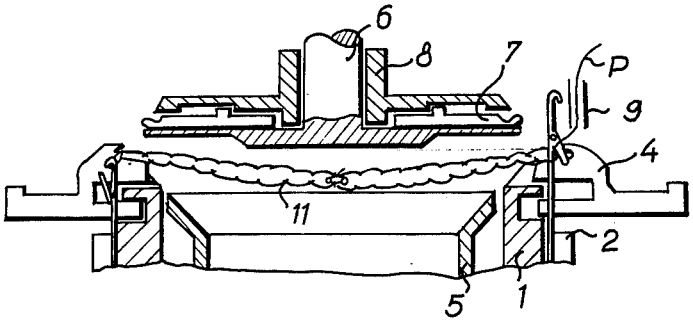
Figure 4:
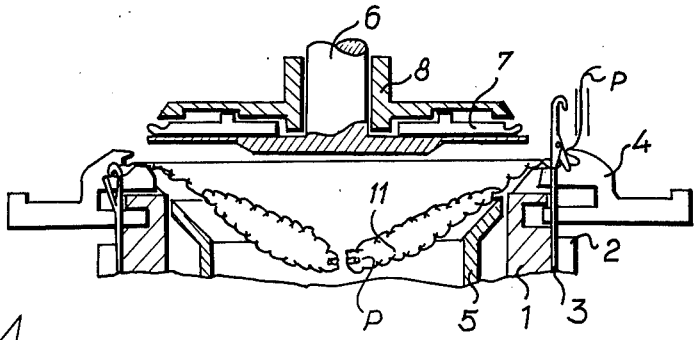

As soon as the toe pocket 11 is sufficiently closed by the yarn P, the yarn P is cut. All of the needles 3, used to form the toe portion 11 are then brought back into operation with at least one of the yarn feeds, preferably that feed in which the wrapping yarn P was introduced. As seen in FIG. 3, as soon as the needles are brought back into operation the sinker loops are transferred from the jacks 7 onto the needles 3 and the courses $m_1$ and $m_4$ are joined together. This doubles over the pocket portion 11 and completes the closing of the portion by knitting the free end of the knitwork to the hose itself. The closing yarn P would about the center section of the pocket 11 is thus enclosed within the pocket itself and the smooth closed toe portion is obtained.

The hose is then completed by in conventional fashion, as seen in FIG. 2 by picking up knitting of the sole portion S with all of the needles in the cylinder. The sole portion is knitted, thusly, with the needles used to form the toe portion as well as that half of the needles, in the cylinder, initially placed out of action before the formation of the toe portion. Thus as seen in FIG. 6 the sole of the hose is formed with twice as many wales as in the toe portion 11. The sole, leg and welt portions of the hose may be finished in accordance with the techniques disclosed in U.S. patent application Ser. No. 872,182, now U.S. Pat. No. 3,754,414, issued Aug. 25, 1973 and Ser. No. 65,978, now U.S. Pat. No. 3,751,942, issued Aug. 14, 1973 respectively, or in any other conventional manner. Finally the stocking is knocked from the needles and withdrawn through the withdrawal tube 5. It will be observed that the finished stocking is provided with a toe portion in which the knitwork is doubled over and layed together having the front face on both the inside and outside of the toe. Because of the laying together of the two layers of the toe portion the toe of the hose is reinforced without increasing its yarn thickness or overall structure.

As seen in FIG. 7 the heterogeneity effect provided by the differently formed wales 12 and 13 can be enhanced and emphasized by laying in one feed system a yarn $P_1$ of low elasticity and in the other yarn system a yarn $P_2$ of greater elasticity. Preferably the yarn $P_2$ having the greater elasticity is supplied to all of those needles in the wale 12 in which the shorter but more numerous loops are formed in a regularly alternating pattern with the less elastic yarns $P_1$. On the other hand the loops in the wales 13 are simultaneously preferably formed only with the less elastic yarn $P_1$. Preferably the elastic yarn is a textured polyamid or other synthetic yarn while the non-elastic yarn may be cotton. The wales 12 in which the elastic yarn is alternated with the non-elastic yarn tends to displace radially behind the wales formed of the totally non-elastic yarns.

In a further aspect of the present invention substantially the same effect of producing knitwork heterogeneity in adjacent wales can be achieved by forming alternating wales totally of an elastic yarn and adjacent wales totally of a nonelastic yarn. Thus wales 12 for example will be formed by a single feed system of elastic yarn while wales 13 will be formed of a feed system having non-elastic yarns. The knitting process will be performed on all of the needles, used in the knitting of the toe portion. In this manner each of the wales 12 and 13 will contain the same number of loops but because of being formed with different type of yarns they will comprise a basically heterogeneous alternating structure. It will be appreciated that by employing the methods described herein the toe portion of the hose is provided with regularly alternating wales of heterogeneous resilient and stitch properties which permit the constriction and closing of the toe portion without undesirable overlapping. The principles of the present invention may be readily adapted to a two needle cylinder machine as well as to the formation of the stocking from the welt portion initially rather than from the toe portion initially. These changes and modifications, as well as others, will be readily apparent to those skilled in the present art. It is intended therefore that the present disclosure be taken as illustrative only of the present invention and not limiting of its scope.

What is claimed is:

1. In a knitwork hose, a closed toe portion consisting of a generally symmetrically shaped pocket formed by a pair of marginal end sections and a central section each having a combination of courses of loop wales less than the number in the remainder of the knitwork hose, each of said marginal end sections having an equal number of loops in the same course section, said central section having a higher number of loops in some of said wales and a lower number of loops in the other of said wales in the same course length whereby the stitch density of the central section is less than the stitch density of the marginal sections, said toe being constricted about substantially the center of said central section to close the same and one of said end sections being doubled over the other and secured together the edges thereof to form said pocket.

2. The hose according to claim 1 wherein the wales having a lower number of loops alternate regularly with the wales having a number of loops.

3. The hose according to claim 2 wherein the wales having a higher number of loops are formed of regularly alternating loops of elastic yarn and non-elastic yarn.

4. The hose according to claim 3 wherein the wales having a lower number of loops are formed with non-elastic yarns.

5. In a knitwork hose, a closed toe portion consisting of a generally symmetrically shaped pocket formed by a pair of marginal end sections and a central section each having a combination of loop wales less than the number in the remainder of the knitwork hose, each of said marginal end sections being substantially the same and having an equal number of loops in the same course section, said central section having a higher number of loops in some of said wales and a lower number of loops in the other of said wales in the same course length whereby the stitch density of the central section is less than the stitch density of the marginal sections, alternating wales being formed with elastic yarn and of nonelastic yarn, said toe being constricted about substantially the center of said central section to close the same and one of said end sections being doubled over the other and secured together along the edges thereof to form said pocket.

* * * * *